US005489032A

United States Patent [19]

Mayhall, Jr. et al.

[11] Patent Number: 5,489,032

[45] Date of Patent: Feb. 6, 1996

[54] MANIPULATOR FOR MASONRY WALL CONSTRUCTION AND THE LIKE

[75] Inventors: Riley H. Mayhall, Jr., Burtonsville, Md.; C. Paul Miller, Rhodesville, Va.; John E. Lorenz, Laurel, Md.; Riley H. Mayhall, III, Germantown, Md.; Mark A. Smith, Woodstock, Md.

[73] Assignee: International Masonry Institute, Washington, D.C.

[21] Appl. No.: 132,340

[22] Filed: Oct. 6, 1993

[51] Int. Cl.[6] ..... E04G 1/26

[52] U.S. Cl. ..... 212/285; 52/749.14; 182/129; 212/224; 212/317; 414/10

[58] Field of Search ..... 414/10, 11, 560, 414/618, 626, 909; 212/160, 211, 224, 285, 329, 317; 52/749; 182/129, 145

[56] References Cited

U.S. PATENT DOCUMENTS

| | | | |
|---|---|---|---|
| 1,347,430 | 7/1920 | Young | 182/145 |
| 2,444,122 | 6/1948 | Wahl | 182/145 |
| 2,859,884 | 11/1958 | Pearce | 182/129 |
| 3,757,484 | 9/1973 | Williamson et al. | 52/749 |
| 5,058,708 | 10/1991 | Herrman | 182/129 |

OTHER PUBLICATIONS

American Beta Corporation Portable Hoist Systems (Brochure), No publication date.

"Solutions for Industry", American Industrial Manipulator Co. (Brochure), No publication date.

Buconrail–Light Crane System, Bucon Corporation (Brochure), No publication date.

"Vacuum Lifters for Bags, Boxes and other Porous Materials", Anver Corporation (Brochure) No publication date.

Coleman Long Ranger Articulated Jib Crane, Coleman Equipment, Inc. (Brochure), No publication date.

CM–"Solutions for a Changing Work Place"–CM Lode Masters, Columbus McKinnon Corp., (Brochure) 1992.

"Pneumatic industrial manipulators", Dalmec (Brochure), No publication date.

"Demag Electric Chain Hoists", Mannesmann Demag Corp. (Brochure), 1982.

ED II, Harrington Hoists, Inc. (Brochure), 1992.

Herculift Articulating Arm, Hermco Manufacturing Inc. (Brochure), No publication date.

Strongarm Industrial Manipulators, J&J Manufacturing Company (Brochure), No publication date.

Jaemar Winches for Pulling, Pushing, Lifting (Full Line Catalogue, Catalogue 4), Jaemar Winches Inc., No publication date.

"Man was not made for lifting . . . ", Conco Manipulator Products, (Brochure), Manufactured by McGill Industries, No publication date.

MY–TE Winch–Hoists "Won't Let You Down", MY–TE Products Inc. (Brochure), No publication date.

CM Solutions "Americas #1 Choice for Material Handling", Columbus McKinnon Corporation (Brochure), 1993.

"Nature Created The Perfect Material Handling Device . . . ", CM Positech, Positech Corporation (Brochure), 1992.

"Self Balancing Lifting Equipment", Scaglia America, Inc. (Brochure), No publication date.

Engineered for The Interaction of Man & Machine, Manipulator Arm Systems, D. W. Zimmerman MFG., Inc. Jun. 1993.

(List continued on next page.)

*Primary Examiner*—Michael S. Huppert
*Assistant Examiner*—Thomas J. Brahan
*Attorney, Agent, or Firm*—Ronald R. Snider

[57] ABSTRACT

An article manipulator system which is suitable for fixed and translative mounting at work sites including on scaffold assemblies, providing for alignment compensation for scaffold non-alignment, providing for limited movement about two vertical axes, providing movement along a trolley track in a generally horizontal direction, and a gripper for grasping heavy work objects such as masonry construction units. A control handle provides for signals for raising and lowering a lift cable and signals for locking and unlocking brakes on said pivot arms and upon said trolley track.

21 Claims, 17 Drawing Sheets

OTHER PUBLICATIONS

"Revised NIOSH Lifting Equation", CDC–Center for Disease Control and Prevention, U.S. Department of Health and Human Services, Jan. 1993.

PM Manulift Electric Hoists–100 to 550 lbs., Mannesmann Demag Corp. (Brochure), 1986.

"Non–Stop Scaffolding Video Brochure", Non–Stop Scaffolding, Inc. (Videotape), No publication date.

"Highspeed Scaffolding", Mighty Equipment (Videotape), No publication date.

Herculift Model OTS Overhead Tracking System, Hermco Manufacturing, Inc. (Brochure), No publication date.

Unimove, Unitech Industries (Brochure), No publication date.

Herculift Roll/Mandrel Gripper Model MMG–200, Hermco Manufacturing, Inc. (Brochure), No publication date.

Herculift Variable Tote Gripper Model MGT–600, Fixed Tote Gripper Model MGT–400, Hermco Manufacturing, Inc. (Brochure), No publication date.

Herculift Rotary Drum Gripper Model RDG–600, Hermco (Brochure), No publication date.

Herculift Bag Gripper Model VBG–100, Hermco Manufacturing, Inc. (Brochure), No publication date.

Herculift Roll/Mandrel Gripper Model MMG–100, Hermco Manufacturing, Inc. (Brochure), No publication date.

MANIPULATOR FOR MASONRY WALL CONSTRUCTION AND THE LIKE

BACKGROUND OF THE INVENTION

1. Field of the Invention

This manipulator is intended for use in industry for active human controlled manipulations of work pieces such as the construction of masonry walls and the like, especially when the weight of the work pieces exceeds that which a human can easily handle, or exceeds that which is permissible by governmental regulations and/or costs of working conditions.

This manipulator will be used in combination with existing work place configurations, equipment or mast type scaffolding used in masonry construction. The manipulator is moved upward along the scaffold as the wall rises, and is capable of substantial lateral movement. The manipulator is intended to be compatible and can be interfaced with existing work place configurations and equipment such as masonry construction methods.

2. The Prior Art

U.S. Pat. No. 4,978,274 shows a robotic device comprising a two part articulated arm and an article holding means at the end of the arm. The arm assembly is mounted on a tower assembly which allows for raising and lowering the arm along the vertical length of the tower. This device is, however, a robotic device lacking a dead man switch, control switches, and a control handle mounted on the apparatus which grabs the article to be manipulated. This patent is fairly typical of the prior art which is concerned with robotics, and therefore, utilizes programmed memories which direct the manipulator during robotic operations.

Manipulators which are non-robotic are also well known in the art. Manipulators of this type are controlled by an operator by a hand grip or a control handle. Applicant has assembled a collection of manufacturers brochures, which describe currently manufactured manipulators. These brochures and product information sheets are included with the prior art statement with this application.

In the brochures known to Applicant, there is no manipulator specifically designed for use on vertical scaffolding, for use in masonry wall construction, and which incorporates the safety features and control features of Applicant's invention.

BRIEF SUMMARY OF THE INVENTION

In this invention, the manipulator is unpowered on its vertical axes, and provides power only for a hoist connected to the tip of the manipulator and to a gripper which is used for gripping work pieces. All rotation about vertical axis is under the control of the operator and is performed manually. It should be understood that the pivots could be powered fully or as a human assist force. The operator grasps a gripper operator handle which causes the manipulator to swing on its vertical axis, causes the hoist to pull the gripper up and down, and which controls the gripper. The manipulator is capable of movement horizontally along a trolley track which is connected to a scaffold system. The operator can move the manipulator along a track by commanding a release of trolley track brakes and pushing the manipulator in a desired direction along the track. It should be understood that the trolley could be powered for movement along the trolley track.

A microprocessor provides for selective locking and unlocking of pivot arms, trolley track brakes, opening and closing of gripper jaws, and response to operator commands which are received from the operator control handle.

A continuous trolley track can be used for movement of the manipulator along the length of a scaffold assembly or it can be attached to any suitable support. Since scaffolds are erected in a less than perfect manner, it is necessary to provide within the manipulator trolley track assembly sufficient mechanical allowance for misalignment of scaffold assemblies. The misalignment is compensated by allowance of the trolley track to extend in a horizontal direction to bend or twist at each scaffold support point, and to provide for sufficient flexibility whereby one section of scaffold can be raised while another remains stationary. In the control system, there is provision for locking of brakes at each vertical pivot axis of the arm under certain operating conditions.

A dead man switch is incorporated into the operating system whereby an operator releases the handle, all braked axis are locked, and the trolley track brakes are locked. Still further, the dead man switch, when released, requires locking of the jaws of the gripper on an article, which is being picked up, as well as locking of the hoist assembly. The dead man switch, when released, causes the entire assembly to lock up, thereby preventing injury to a human worker.

The article manipulator and method of this invention is especially useful for laying of block wall and the like where the masonry units are heavier than a human can reasonably handle. The use of this type of manipulator will provide for faster wall construction because heavier masonry units can be set into the wall, thereby reducing the total number of units.

DETAILED DESCRIPTION OF A PREFERRED EMBODIMENT

Figure 1:
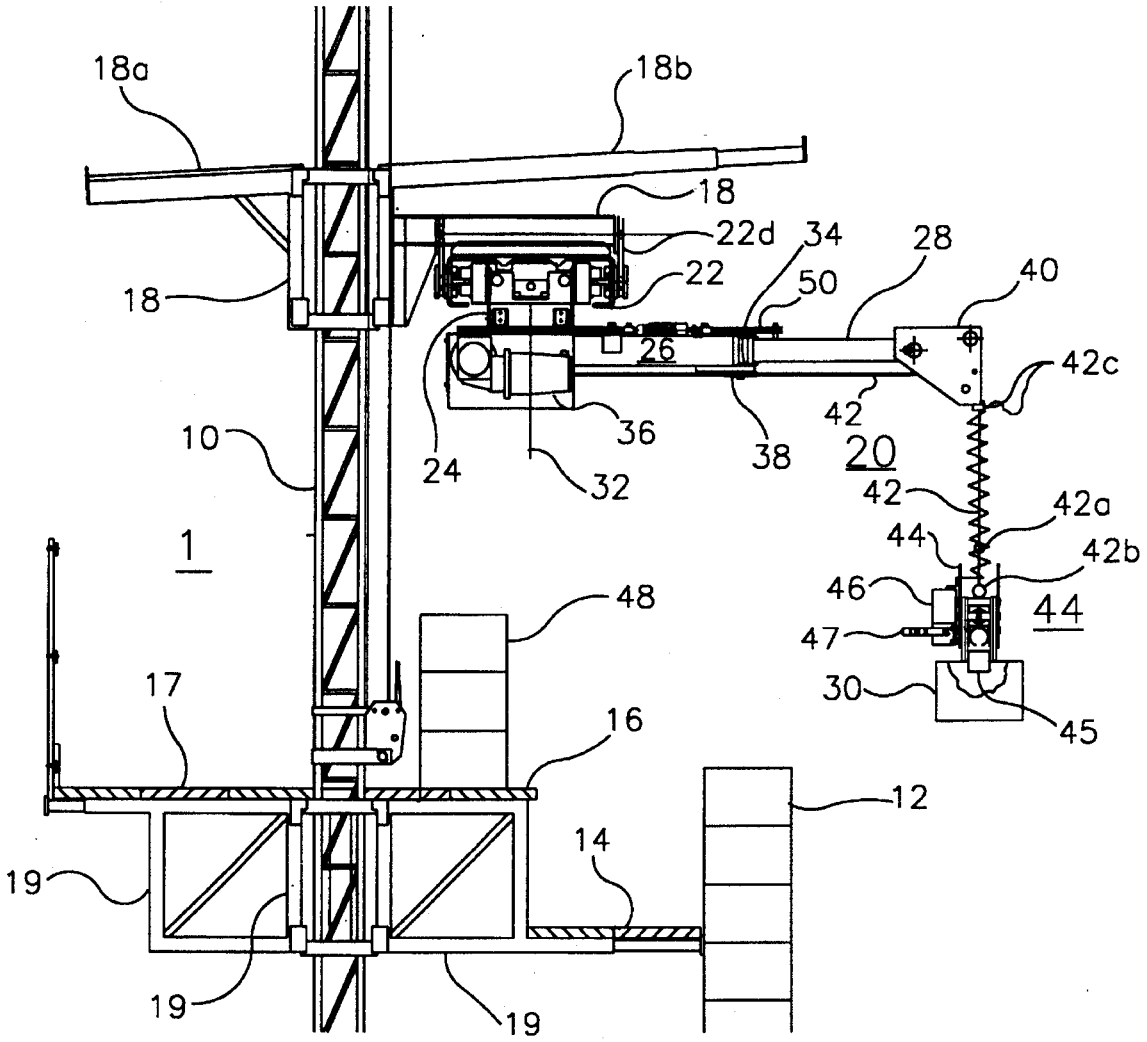
FIG. 1 shows a side view of a manipulator.

In FIG. 1, there is shown a side view of the manipulator 20 mounted on a scaffold mast 10. It should be understood that this manipulator arm assembly could be pivotally attached to any other suitable support mobile or structure. Also shown is a cross section of a masonry wall 12, a standing platform 14 and a material platform 16. When the system is in use, there are a plurality of scaffold masts 10 generally aligned along the face of a masonry wall 12. The platform 16 is raised up along the masts 10 as the wall height increases. Similarly, there is a manipulator canopy support frame 18 which carries the manipulator and moves upward along with the wall. In all job sites, the masts 10 are not necessarily in alignment vertically or even evenly spaced. This requires that there be flexibility in the attached structures so that the platform frame 19 and the manipulator frame 18 can move with the mast 10 while the associated equipment is permitted some degree of movement. For instance, in the case of the platform 16, the horizontal boards or supports 17, 16 and 14 are permitted to move with respect to the supports. In the case of the manipulator support 18, there must be flexibility to allow for hole misalignment in all three axis, while at the same time permitting the manipulator to move along the length of the wall while riding on a manipulator trolley track 22.

The manipulator 20 includes a trolley track 22 mounted on the manipulator support 18. A trolley assembly 24 rides along trolley track 20 to carry the first pivot arm 26 along the length of the track. The first pivot arm 26 has attached to it a second pivot arm 28 which extends generally radially outward from the pivot arm 26 and permits manipulation of a work piece 30 by movement along the track 22, rotation of the first arm 26, and rotation of the second arm 28 with respect to the first arm 26 about pivot point 32. Arm 26 rotates about pivot axis 34. These three degrees of freedom permit the block to be moved along the length of the track 22 and inwardly and outwardly from the wall 12 to the platform 16 to pick up materials or work pieces such as a block 30.

Next, the manipulator includes a lifting or hoist mechanism for raising or lowering work piece 30. A motor and reduction gear drive assembly 36 is mounted on the first pivot arm and a cable or chain extends from the hoist motor assembly 36 through a first pulley assembly 38 on the first pivot arm, and to a second pivoted pulley assembly 40 mounted at the tip of the second pivot arm 28. A braking mechanism for pivot axis 32 and 34 lies generally on top of pivot arm 26. The braking assembly is generally indicated by the reference numeral 50. The cable 42 extends downward to a clamp assembly or grasping assembly 44 and is equipped with positive stop **48*a* and quick disconnect 48*b*. Integral to the grasping assembly 44 is a manipulator control handle and control handle sensor mechanism 46. The control handle 47 includes a dead man switch, operator manipulated controls and handle 47. The combination of movement along the trolley track 22, rotation about pivot axis 34, rotation about pivot axis 32, and lifting or lowering of cable 42 permits an operator to pickup work pieces from a work piece supply area 48 and to manipulate the work pieces into position along wall 12**.

Figure 2:
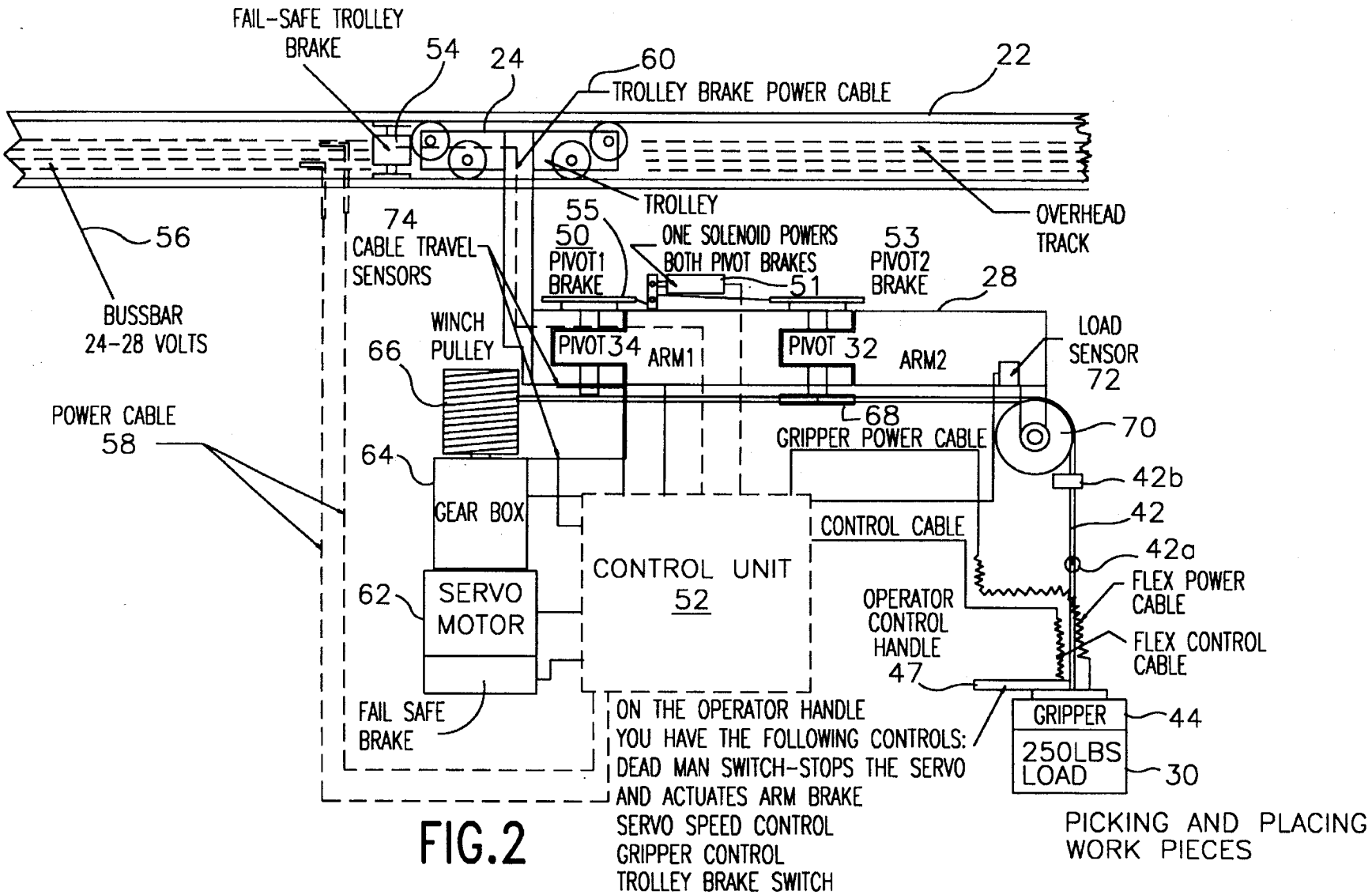
FIG. 2 shows an overall functional diagram of the manipulator and over head trolley and track assembly.

Trolley track 22 and trolley 24 can be locked together or braked upon command from the operator. The controller for the manipulator is mounted on the first pivot arm 26. The material handling mechanism comprises the manipulator in combination with the scaffold, operator platform, and trolley track assembly. In FIG. 2, there is shown an overall functional diagram of the manipulator 20 and overhead trolley track assembly. A low voltage bus bar as shown in FIG. 2, the trolley track 22 carries bus bars 56 which provide low voltage to power cable 58. It should be understood any other drive source could be employed in this method. The trolley track also includes a fail safe brake 54 which is applied whenever there is a loss of power or appropriate command from the control unit 52. The trolley brake power cable 60 connects the brake unit mounted on the trolley 24. The control unit provides power to the hoist assembly which includes servo motor 62, gear box 64 and a winch/pulley 66. The cable 42 then connects the winch to the gripper 44 after the cable passes through a guide 68 and overhead pulley 70. The operator control handle 47 provides for the dead man switch which stops the lift drive and actuates arm and servo brakes when the switch is released. A load sensor 72, such a force transducer, is mounted on the tip of the second pivot arm 28 and provides direct load information to the control unit 52 which is used in the control sequence. Similarly, cable travel sensors provide cable spool out information to the control unit 52. The pivot axis 32 and 34 are provided with brakes 50 which comprise a solenoid and linkage assembly 51 which releases and locks the pivot brakes 53 and 55 on the second arm and first arm respectively. In this manner, the pivot brakes 53 and 55 are actuated or released simultaneously.

Figure 3:
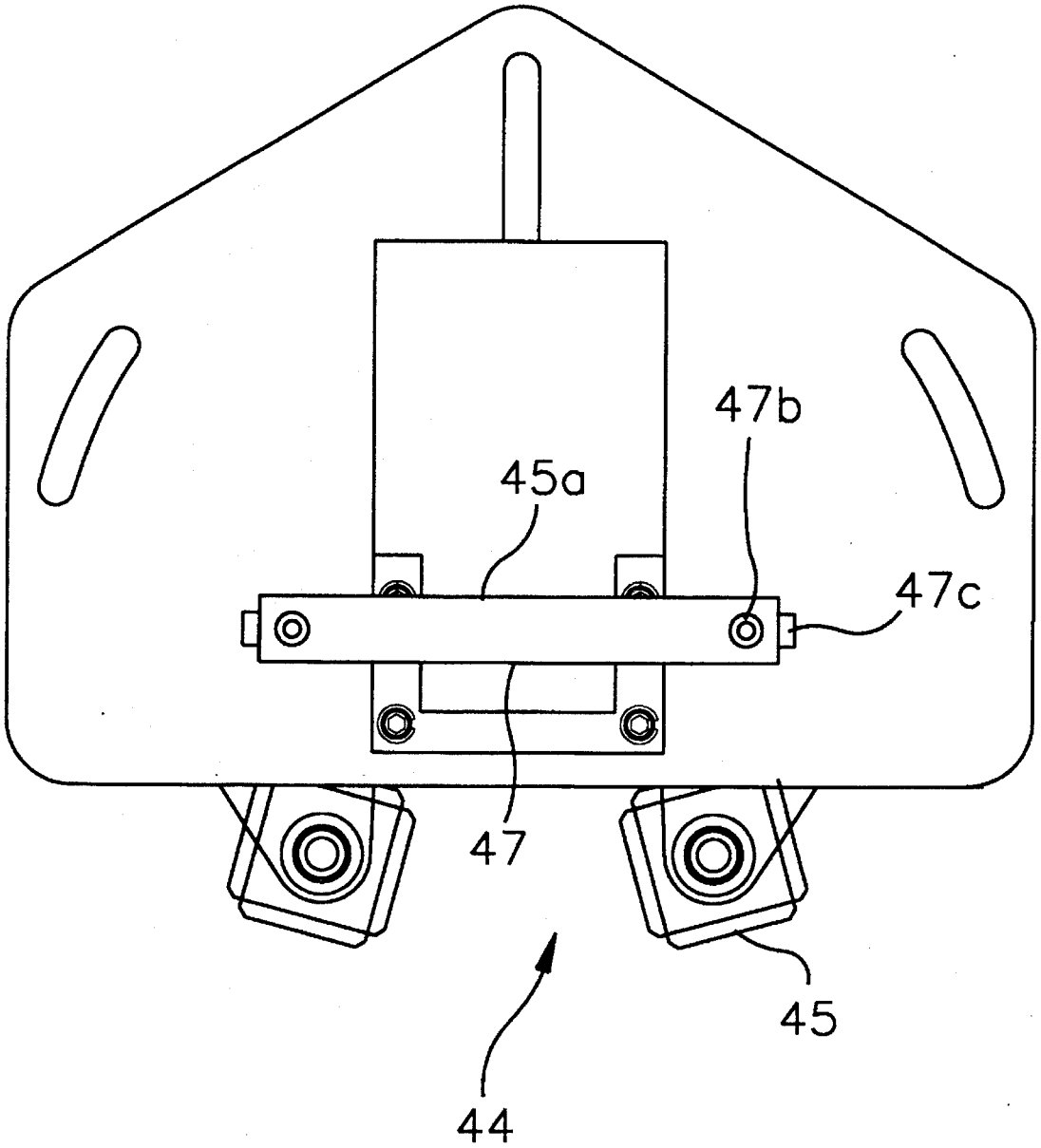
FIG. 3 is a side view of the grip assembly.

In FIG. 3, there is shown a side view of the gripper assembly 44 which includes jaws 45 which grasp or clamp a work object 30 as shown in FIGS. 1 and 2. The gripper actuating mechanism comprises an electrical power means which can be driven from controller 52 as shown in FIG. 2. It should be understood any other power means can be employed. The mechanical gripper mechanism may be a screw assembly driven by a motor or any similar mechanism. A fluid powered gripper can be used as an alternative. The mechanical actuator is generally indicated at **45*a***.

Figure 4:
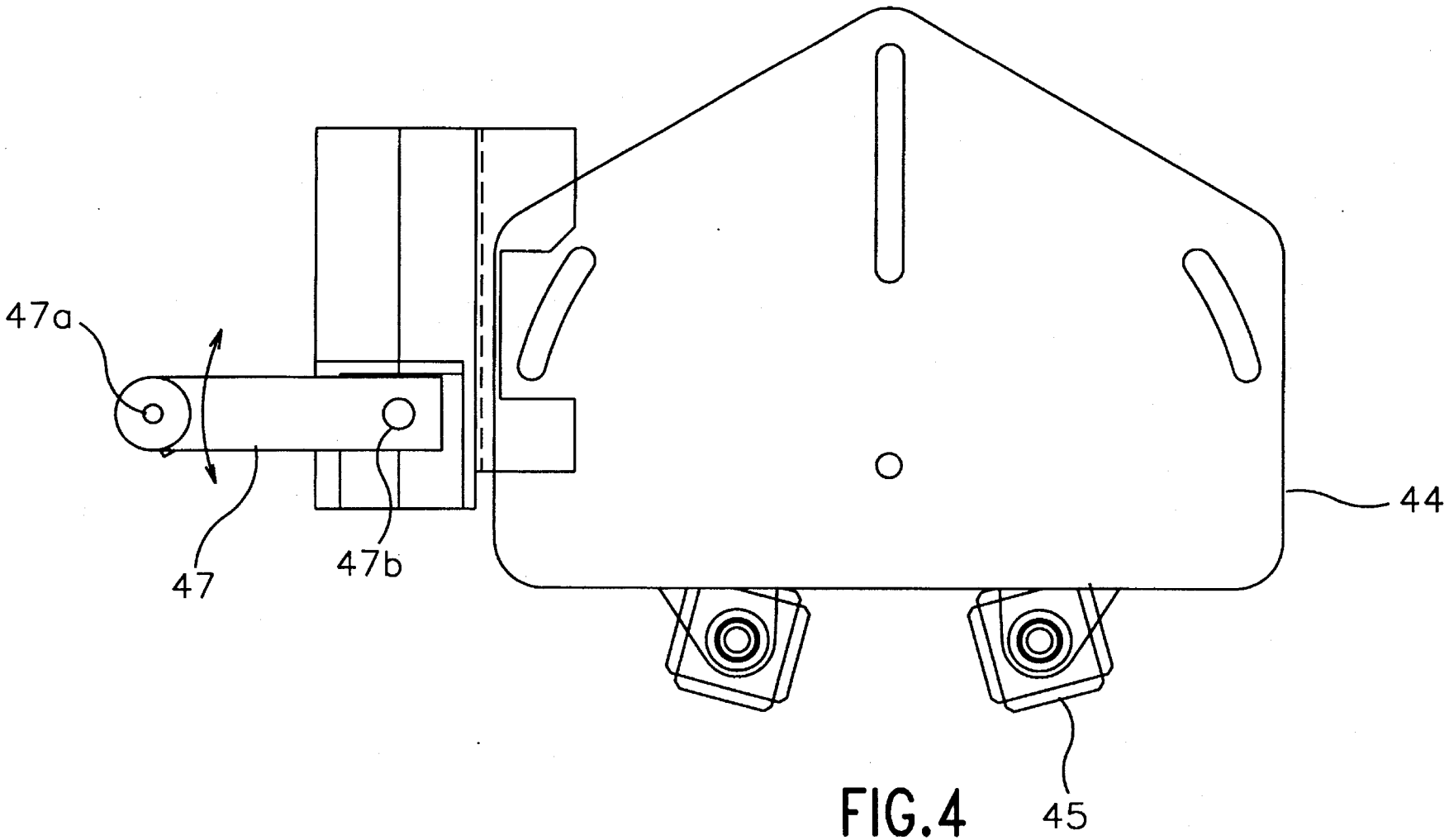
FIG. 4 shows a side view of the gripper as seen from the outside.

In FIG. 4, there is shown a side view of the gripper 44 as seen from the outside. The operator control handle 47 is shown at the left side. Operator control handle 47 is preferably a d-handle that can be used for any high force push pull and torque operator having control switches on each end of the handle which are duplicates. Control switches **47*a* are duplicated on both sides of the handle so that it is easily controlled by a right or left handed person. Control handle 47 also includes the dead man switch along the center of the "d" which must be actuated in order to provide for any power movement and to permit release of brakes on the pivot axis 32 and 34 as well as the brakes on the trolley assembly 24. The trolley assembly brakes are generally indicated as reference numeral 54 in FIG. 2. Also, it is shown in FIG. 4, the control handle is free to move upwardly and downwardly or to rotate about a pivot axis 47*b*. As the control handle 47 rotates about 47*b*, and encoder senses the position of control handle 47 thereby sending a signal to controller 52 which represents the angular deflection of handle 47. This angular deflection is used and an error signal for control of a velocity responsive servo which feeds the cable either upwardly or downwardly depending upon the direction of rotation of the handle 47**.

Figure 5:
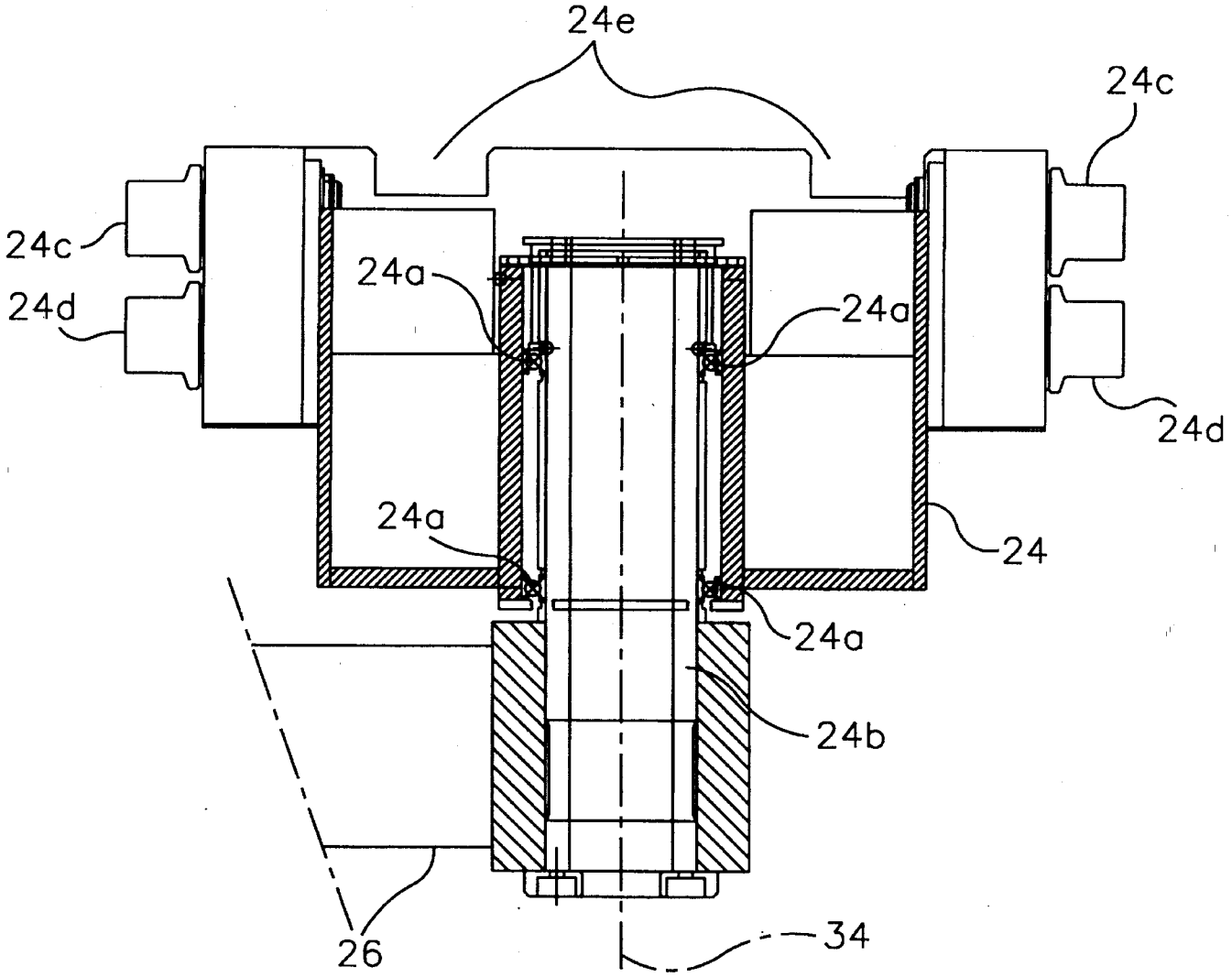
FIG. 5 shows a cross sectional view of the trolley.

FIG. 5 shows a cross-sectional view of the trolley 24 and the first pivot assembly along the axis 34. Trolley 24 includes a bearing **24*a* connected to a shaft 24*b* which is fixed to the first pivot arm 26 any suitable bearing may be used to provide the connection between shaft 24*b* and bearing 24*a*. Wheels 24*c* and 24*d* secure the trolley 24 to the track guide assembly included in the trolley track 22 (not shown in FIG. 5). Key slots 24*e* are provided to maintain correct trolley installation with trolley track 22**.

Figure 6:
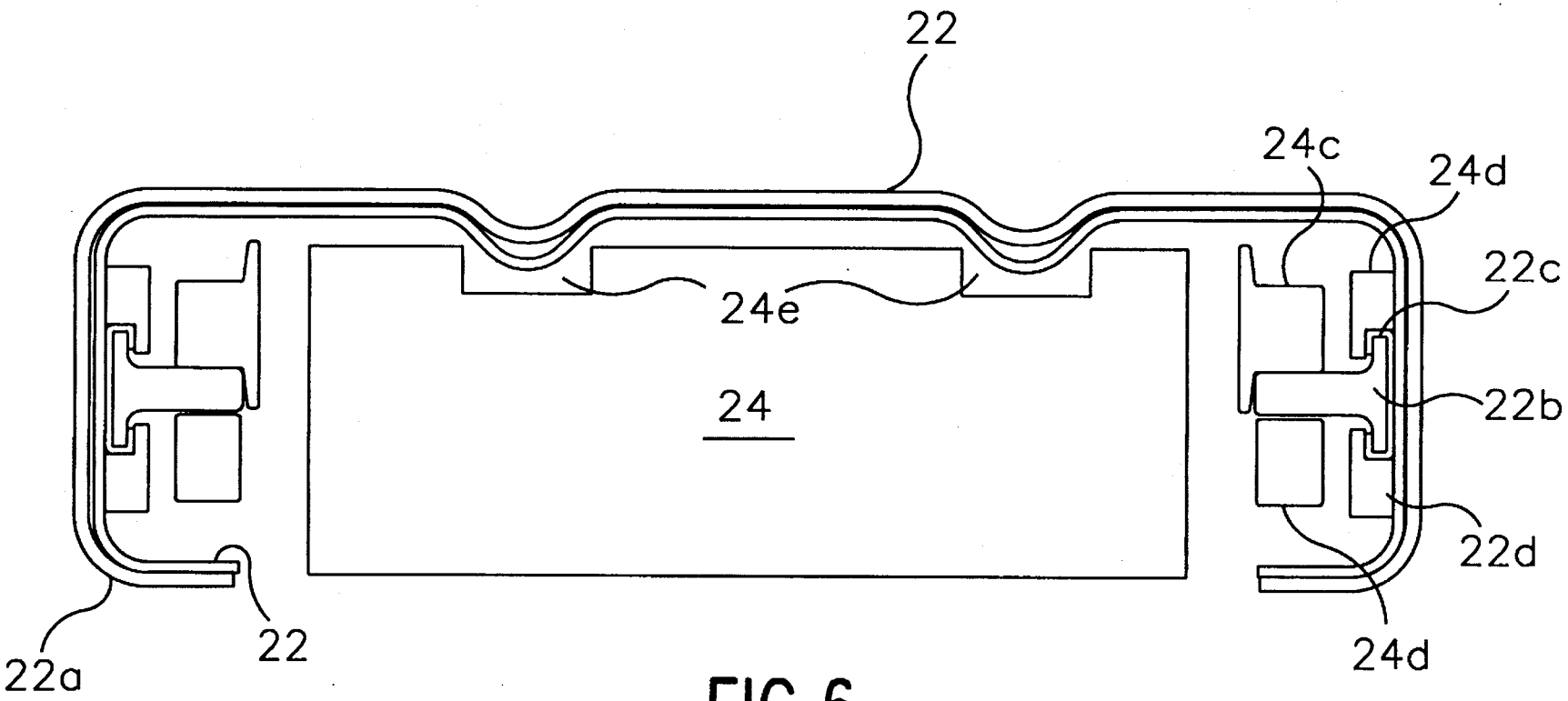
FIG. 6 is an enlarged cross sectional view of the trolley track.

In FIG. 6, there is shown an enlarged cross-sectional view of the track 22 including trolley 24, trolley wheels **24*c* and 24*d*, and trolley wheel guide conductor 22*a*. Trolley wheel guide conductor 22***a* is electrically insulatingly fixed inside trolley track member and is constructed to allow movement which is along the length of the trolley track 22 which makes the entire assembly longer or shorter dependant upon the demands of the misalignment of the scaffold masts 10. Track insulators 22*c* are shown in FIG. 6. Track clamps or holders 22*d* are shown in FIG. 6.

Figure 7:
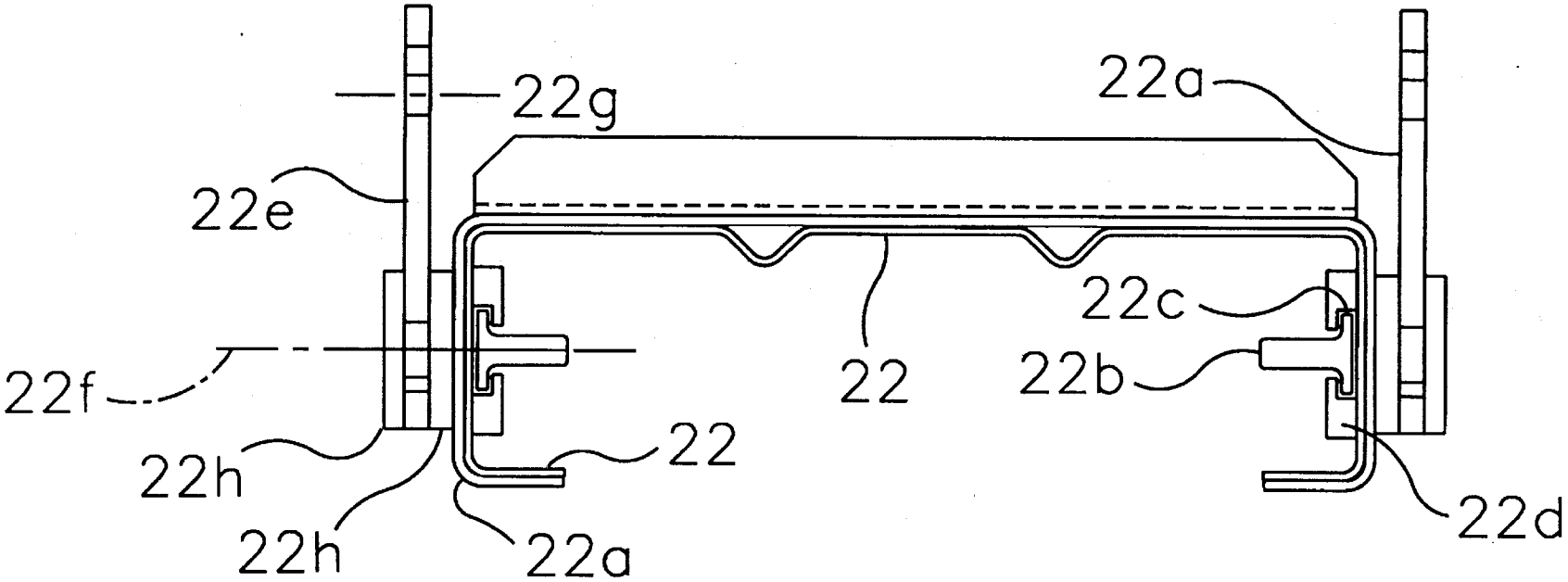
FIG. 7 shows a cross sectional view of the trolley track and the trolley track hangers.

In FIG. 7, there is shown a cross-sectional view of the trolley track 22 and the trolley track hangers 22*e* which extend downwardly from a support 18 as shown in FIG. 1. The track is permitted to rotate about the axis 22*f* and axis 22*g* in order to provide for misalignment of the track in a vertical plane which will occur during raising and lowering of the track, or during use where alignment is not exact. The hangars 22*e* are also permitted to rotate about a pivot axis 22*g* which connects the hangers to the boom 18 as shown in FIG. 1.

Figure 8:
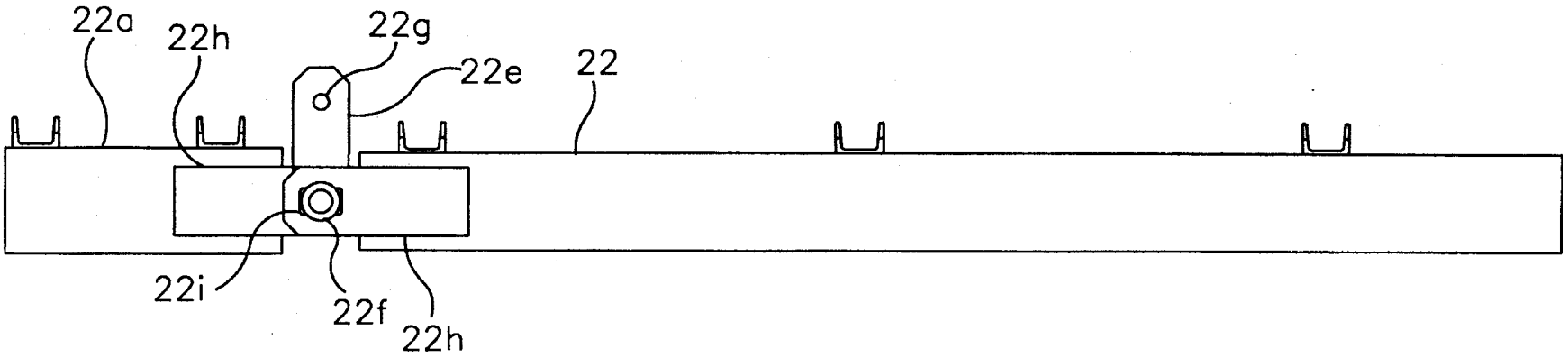
FIG. 8 is a side view of the track assembly.

In FIG. 8, there is shown a side view of the track assembly 22 with hangers 22*e*, pivot axis 22*f* and pivot axis 22*a*. Suitable support brackets 22*h* are slidingly connected by slide bearing 22*i* secured to each section of track 22 and track 22*a*.

Figure 9:
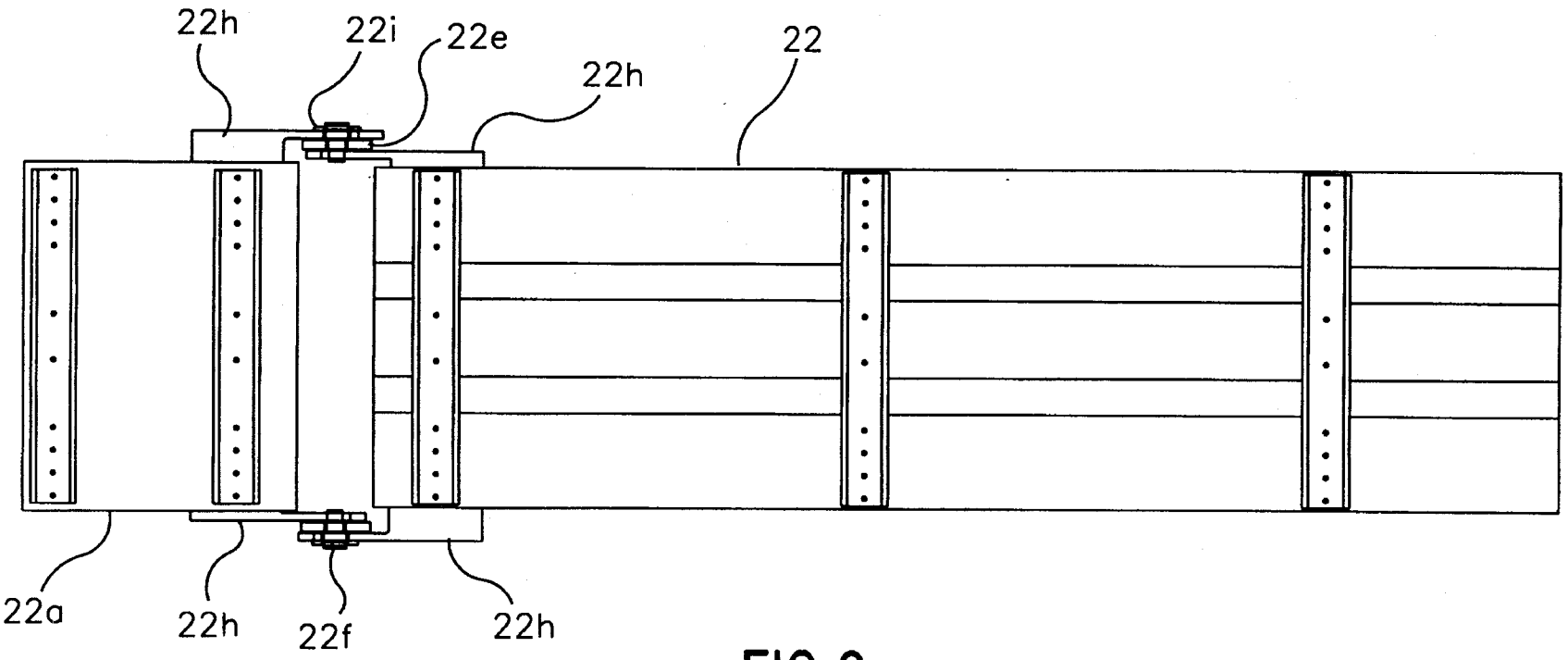
FIG. 9 is an overhead view of the track with its pivot axis.

In FIG. 9, there is shown an overhead view of the track 22 with pivot axis 22*e*. The trolley track hanger 22*e* is shown slidingly connected between two arms 22*h* and slide bearing 22*i* which permit skewed movement of the track 22 laterally along the length of the scaffold assembly constructed of scaffold masts 10.

Figure 10:
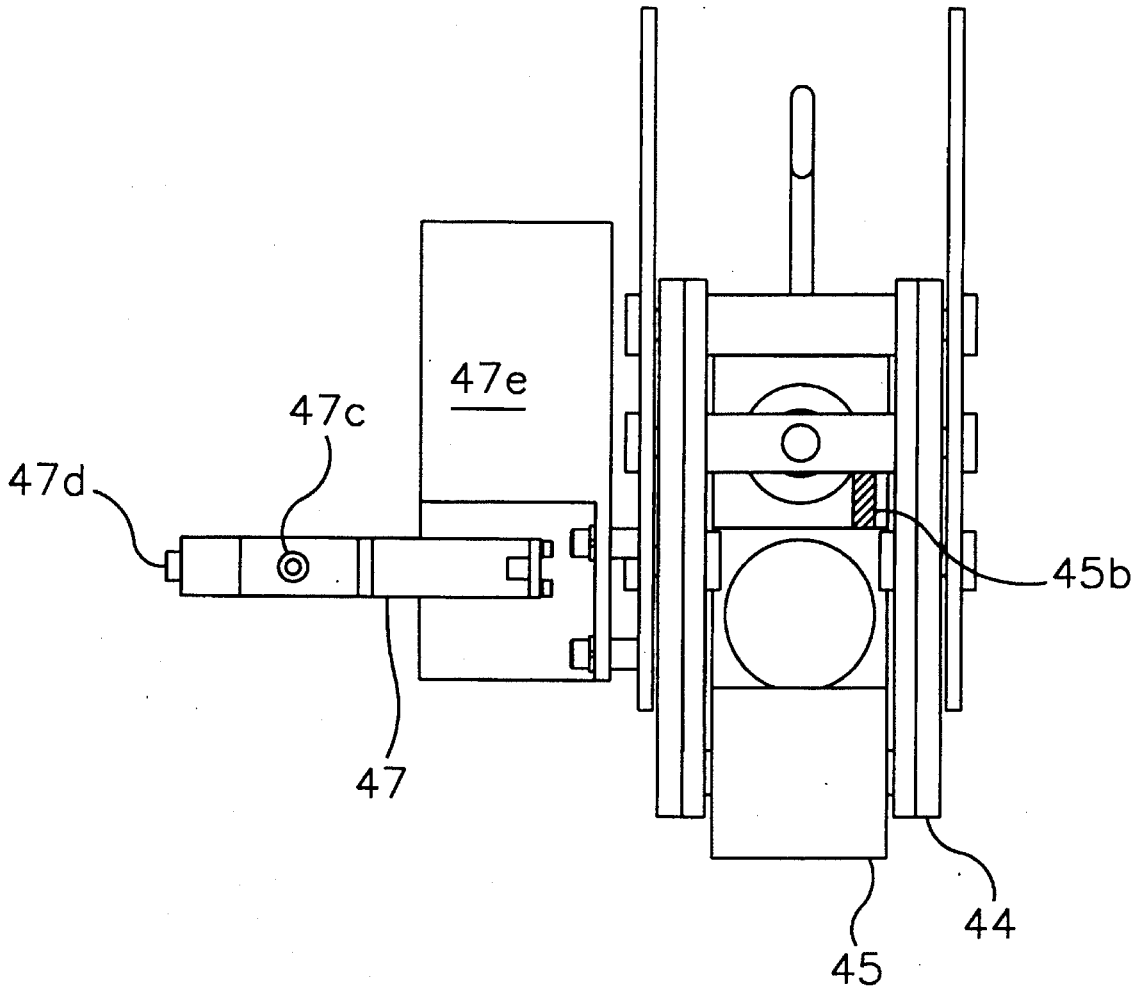
FIG. 10 is a cross sectional view of the gripper and operator control handle.

In FIG. 10, there is shown a cross-sectional view of the gripper 44 and operator control handle 47. The control handle is shown with the dead man switch 47*d* and an operator control button 47*c*. The sensors for the control handle 47 are generally located in the control handle box 47*e*. Gripper jaws 45 are shown in FIG. 10.

Figure 11:
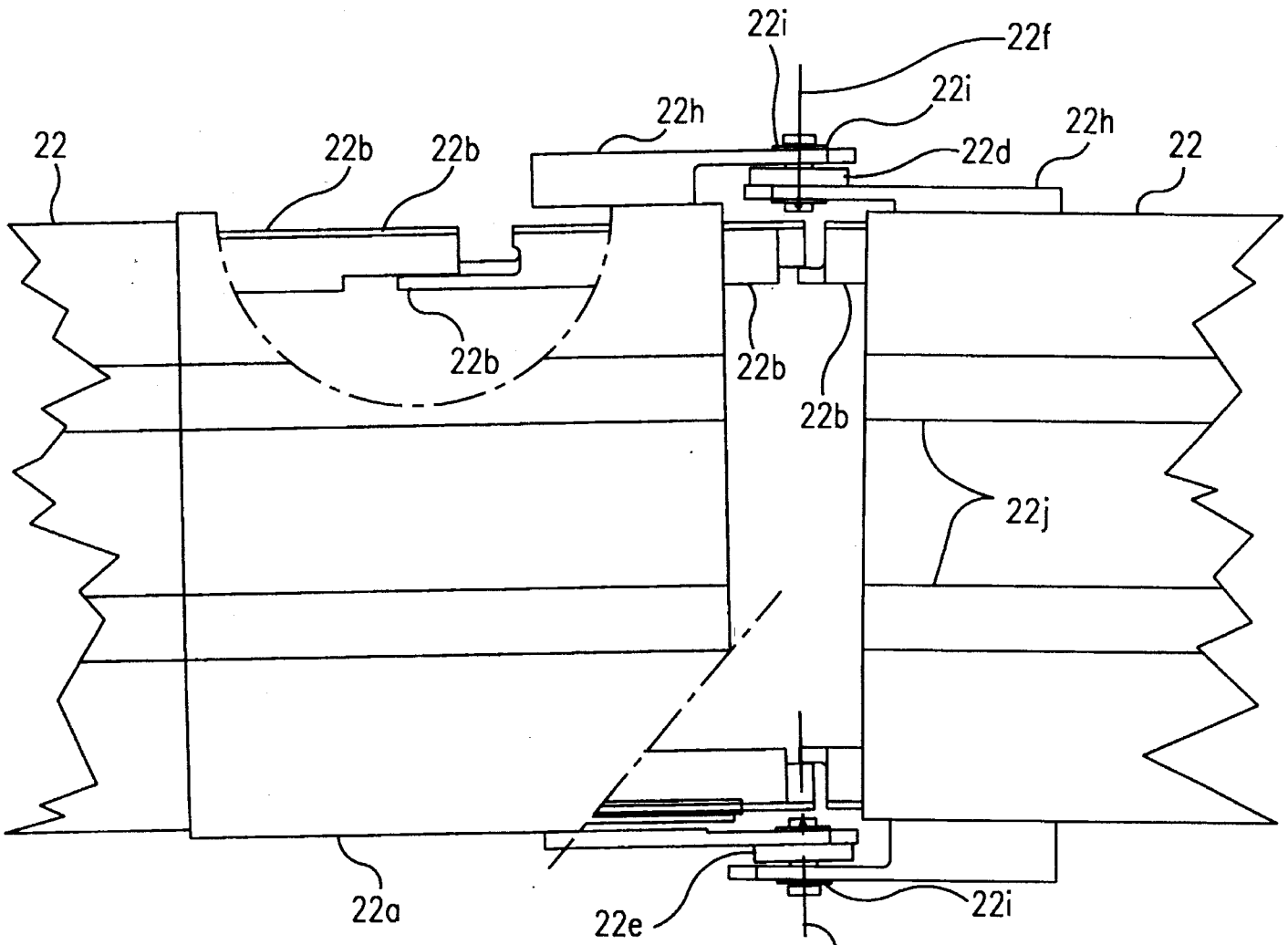
FIG. 11 is an expanded view of the track with its guides.

In FIG. 11, there is shown an expanded top view of the track 22 with the guides 22*b*. The guides 22*b* must provide a continuous path for the trolley wheels 24*c* and 24*d* along the lateral length of the scaffold assembly 1 in order to permit for misalignment the scaffold masts 10 in any vertical plane. The trolley track 22 must also be capable of extending or contracting in length along the lateral distance of the entire scaffold assembly. This lengthwise movement is provided by an overlap and supplying arrangement 22 and 22*a* and the affixed track guides 22*b*. This permits a continuous track for the rollers 22*c* and 22*d* as the track extends or is shortened. The track assembly also provides for rotation about the pivot axis 22*f* and 22*g* in a horizontal plane. This is shown in FIG. 11 whether the extension of the track overlap at the bottom is indicated to be less than the extension of the overlap at the top. Track sections 22 and 22*a* are shown in horizontal misalignment in FIG. 11 where the movement is permitted at the location of axis 22*f* and slider bearing 22*i*. Stated another way, the track 22 is permitted to slide back and forth within 22*a* which separates affixed guides 22*b* 22*g* and 22*h*. Skewing may be accomplished by means of a rectangle slot 22*h* and slider bearing 22*i* as shown at the top of FIG. 11 to maintain correct trolley 24 installation, keys 22*j* are provided.

OPERATION

In operation, all control of the manipulator is by the operator while placing one hand on gripper "d" handle 47. Starting from the position shown in FIG. 1, the sequence of operations is as follows.

By grasping "d" handle 47, the block 30 may be pulled to the right in order to align the block with the top of the wall 12. This movement requires only rotation about the pivot axis 32 and 34. These movements are not powered by the manipulator, but are purely powered by the effort of the human through his grasp of the control handle 47. It should be understood in heavier applications, mechanized assistance will be provided. Once the block 30 is located above the wall 12 and aligned with the wall in the location for placement, the operator then may raise or lower the block with respect to the wall 12 by merely pulling upward or downward on the control handle 47. This upward and downward movement produces an error signal which is fed to the controller 52 and which is used as a velocity control for the hoist motor 62. The velocity of motor 62 may be a lineal function of the angular displacement of handle 47 from horizontal, or it may be a non-linear function such as increasing speed substantially as the angle of the handle 47 increases away from the neutral no lift position. Once the block is in proper position above the wall, the operator then may decide to lower the block by merely lowering handle 47. As the block moves downward into position in the wall, it may be necessary to further adjust the position of the block in the horizontal plane of the wall. This may be done by the operator by merely rotating the assembly at pivot axis 32 and 34 by manual force only. The block 30 may be also rotated about its vertical axis by merely rotating the handle 47 in order to twist the gripper and block by twisting of the cable 42 in the section where it is connected between pulley 40 and the gripper assembly 44.

Once the block is in place in the wall and ready to be set into a mortar bed, the operator can slowly lower the control handle 47 to ease the block into the mortar prior to releasing of the block by the gripper mechanism 44. Once the cable 42 slackens, the gripper 44 can be opened by means of the gripper control button located on handle 47. The manipulator is then returned to the location of the platform 16 for picking up another block.

The open gripper 44 is raised by raising the handle 47 and actuating the servo motor 62 to raise the gripper. The gripper is then moved again in a horizontal plane by the operator's grasp of handle 47 until the gripper aligns with another block 48 to be placed in the wall. Here, the gripper will be lowered until it engages block 48, and then it will be actuated by closing the gripper and grasping block 48. Block 48 is then lifted by means of raising the "d" handle 47. The block can be manipulated to a location at a mortar bed in the wall by the operator's manipulation of the manipulator about axis 32 and 34.

So far, the manipulator has been described in its working condition where work pieces are being removed from the scaffold and placed into the wall 12. In this condition, the controller is used only for raising and lowering of the hoist. However, in this condition, the controller also mandates that the brakes 54 between the trolley 24 and the trolley track 22 be locked. This locking of the brakes at the trolley track allows safe movement of the manipulator without any movement along the trolley track.

Once an operator has exceeded the reach of the manipulator arms 26 and 28, it will become necessary to move the manipulator along the length of track 22. This is accomplished by the operator pressing a move button or control on the manipulator 47 which is received by the controller 52. When the move button is depressed, the brakes 54 are released, and simultaneously brake assembly 50 locks the movement of the manipulator about axis 32 and 34. This permits transverse movement along the track 22, but locks the arm on axis 32 and 24 for the purpose of preventing uncontrollable swinging of the manipulator which is to be avoided, especially when working on a scaffold.

The movement of trolley along the track is also responsive only to the force exerted by the operator. It should be understood that the trolley can be powered particularly in heavier applications. The operator may press the arm around the location of axis 34 in order to move the trolley down the track to another location where the arm can once again reach material and move it into a desired place in the wall 12.

The dead man switch 47*d* senses the presence of the operator's hand at the control. Whenever dead man switch 47 is released indicating that the operator is not in control of the arm, all brake axis and the hoist lift are locked. The controller provides for locking of the trolley brakes 54, and the brake assembly 50 which controls motion about both pivot axis 32 and 34.

Since the dead man switch is a master control for all brake systems, the manipulator will be in a locked condition with respect to the trolley track 22 at all times when the operator is not grasping control handle 47. During manipulation and maneuvering of the scaffold 16 and the manipulator frame 18, the manipulator is locked in all axes. This permits the movement of the scaffolding with respect to the track 22 without uncontrolled swinging and movement of the manipulator 20.

In FIGS. 12*a*–12*d*, there is shown the control sequence for the manipulator which is a function of controller unit 52.

Figure 12A:
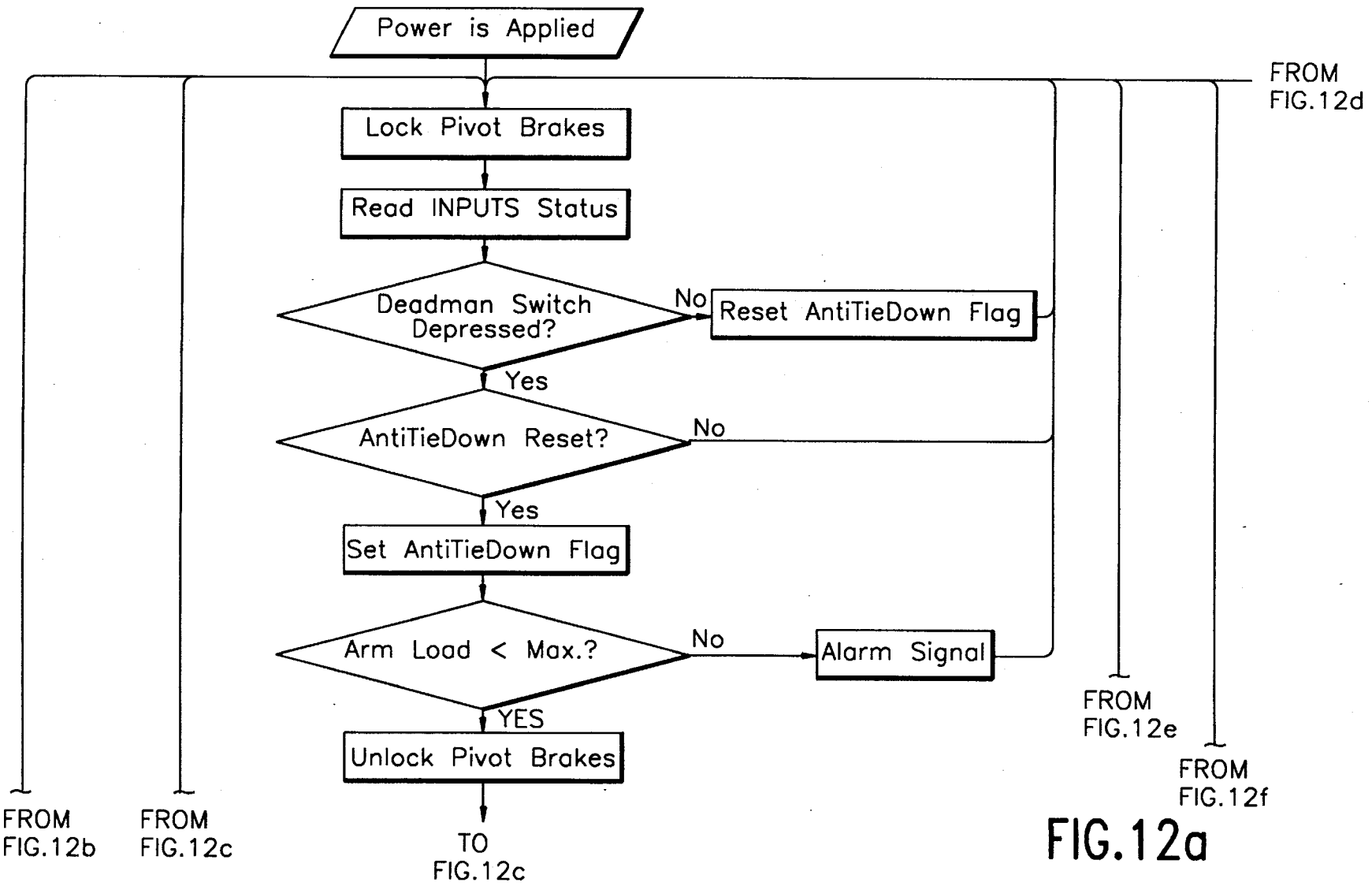
FIG. 12*a* shows the control sequence which controls the pivot breaks and the dead mans switch.

As shown in FIG. 12*a*, when power is applied, pivot brakes are locked and when the dead man switch is pressed, and the anti tie-down is reset, the anti tie-down flag is set. Next, the controller determines if the arm load is less than a predetermined maximum. This predetermined maximum is determined by load sensor 72. When the load is less than the maximum, the pivot brakes 50 may be unlocked. At this step, the controller reads the push button settings and the handle status.

Figure 12B:
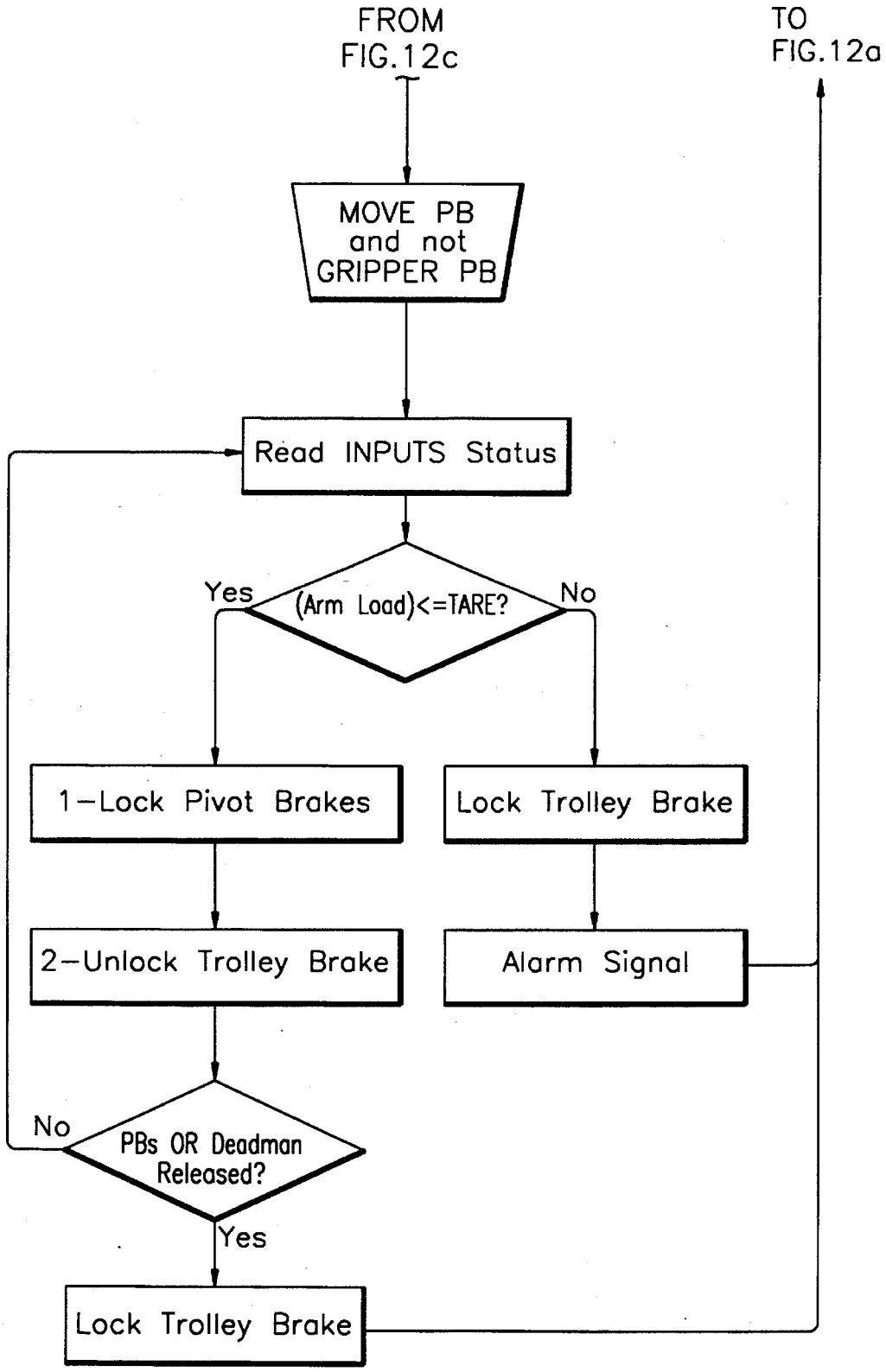
FIG. 12*b* shows the control sequence responsive to the move push button.

As shown in FIG. 12*b*, when the move push button is pushed, and the gripper push button is not pushed, the controller determines if the arm load is less than or equal to a tare weight. The tare weight is the maximum permissible load on the arm which is a function of the block weight. When the arm load is less than the tare weight, the pivot brakes 50 are locked and the trolley brakes 54 are unlocked, thereby permitting movement of the manipulator along track 22. Next, the program checks to see if the dead man is released. If the dead man does not release, the trolley may move along track 22. However, if the dead man is released, the trolley brakes 54 will be locked and the control will be returned to the beginning of the sequence. When the arm load is equal to or greater than the tare weight, the trolley brakes are locked and an alarm signal is applied to tell the operator that too much load is on the manipulator to prevent movement along the trolley track.

Figure 12C:
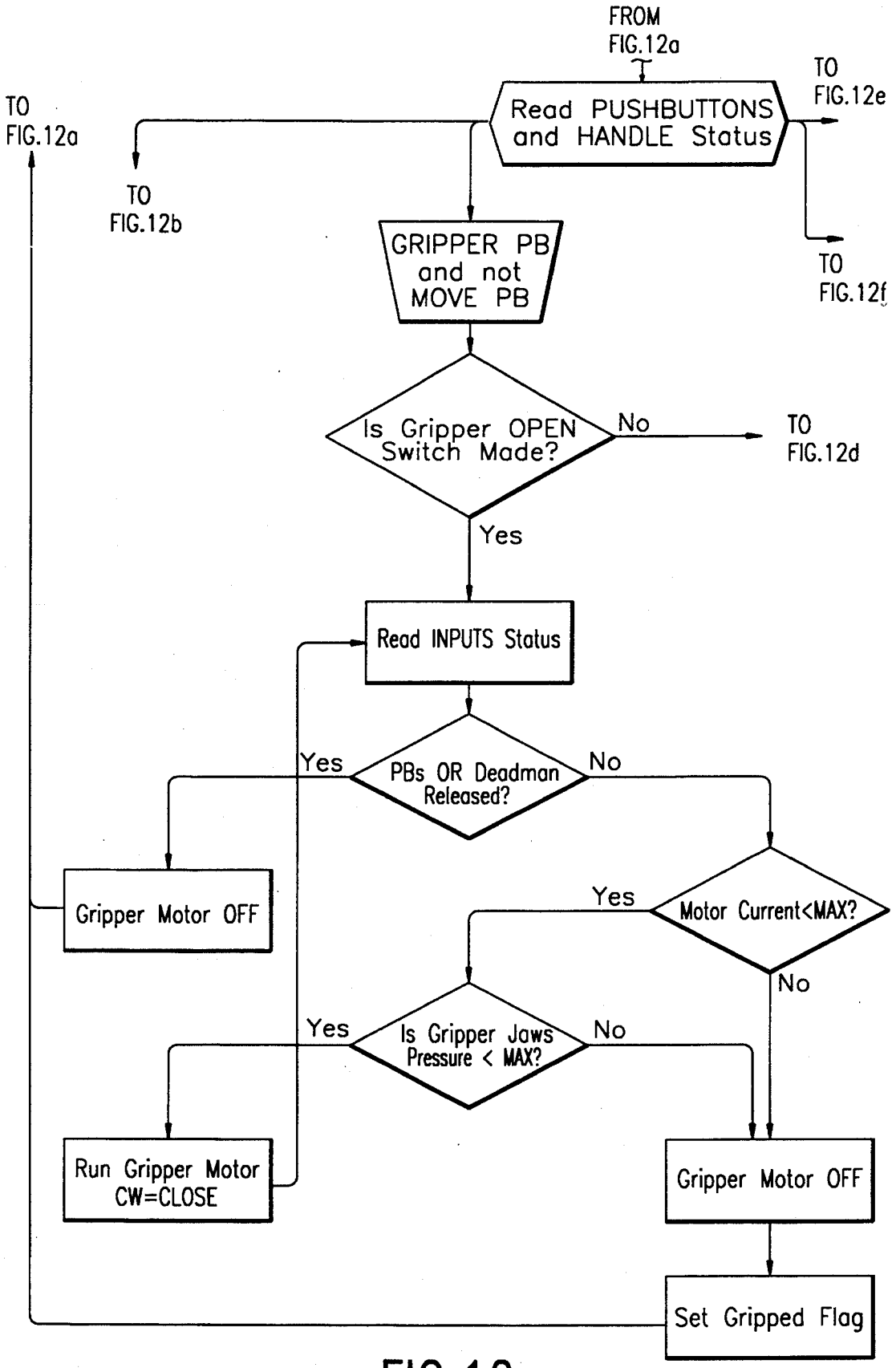
FIG. 12*c* shows the control sequence responsive to the gripper push button.
Figure 12D:
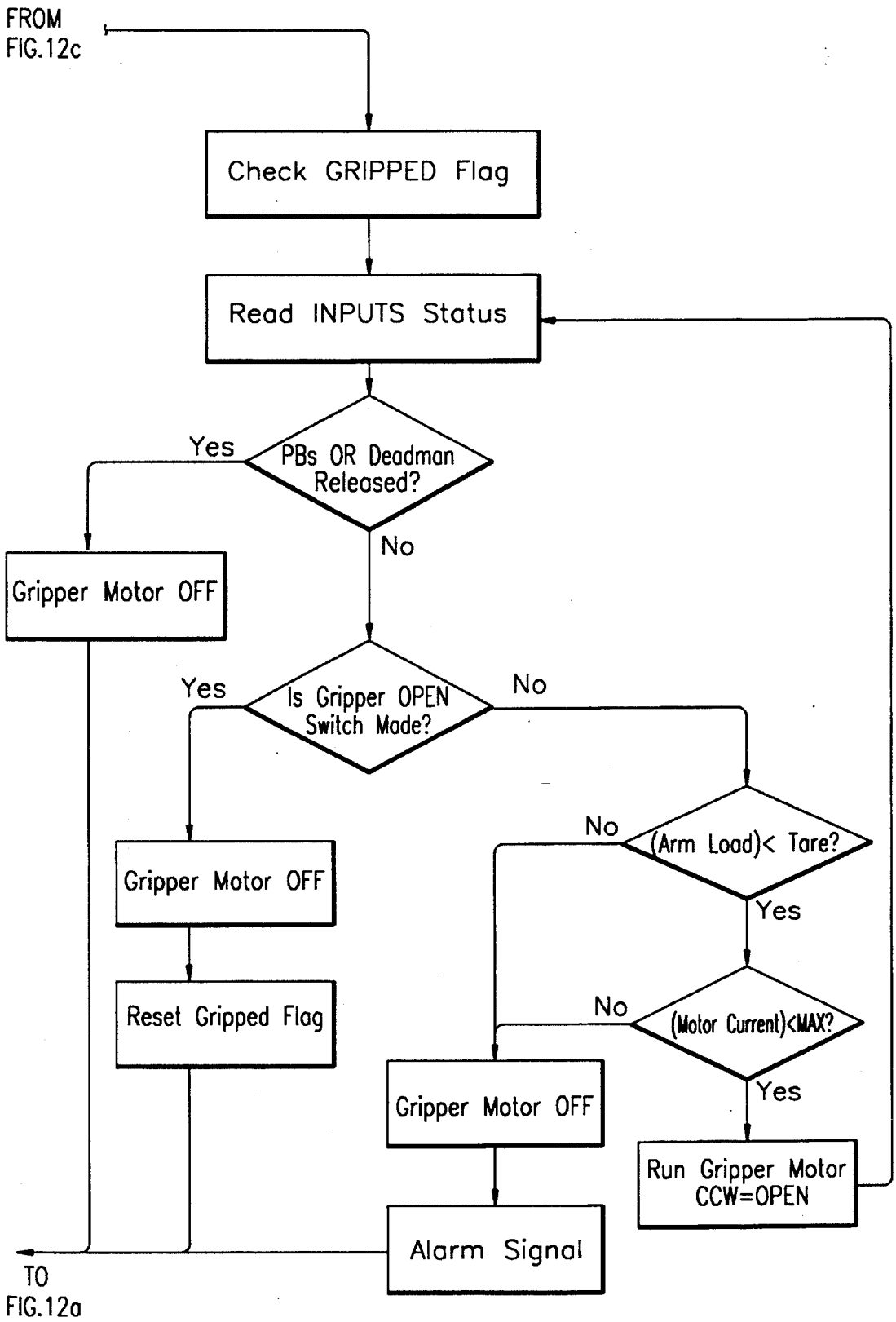
FIG. 12*d* shows the control sequence of the gripper switch is not open.

As shown in FIG. 12*c*, when the gripper push button is depressed and the move push button is not depressed, the controller checks to see if the gripper is open. The gripper includes an open switch as shown in FIG. 10 as reference numeral 45*b*. When the gripper switch indicates that the gripper is open, the program then determines whether the dead man switch is released. If the dead man switch is released, the gripper motor is maintained in an off position. When the dead man switch is not released, the motor current of the servo motor 62 is sensed to determine if it is less than a predetermined maximum. If the motor current is less than the maximum, the gripper jaw pressure is determined and compared to a maximum. If the gripper jaw pressure is less than the maximum, the gripper motor will move clockwise and close the gripper. However, if the motor current is equal to or greater than the predetermined maximum, the gripper motor is turned off and a gripped flag is set. Again, as shown in FIG. 12*d*, when the gripper switch is not open, the program considers whether the dead man switch is released. In the condition where the dead man switch is released, the gripper motor is turned off and control is sent back to the beginning. Where the dead man switch is not released, the program then determines if the gripper switch is open. When the gripper switch is open, the gripper motor is off and the grip flag is reset. When the gripper open switch is not closed, the arm load is compared to the tare weight and when arm load is less than the tare weight, the motor current is compared to the motor current maximum. In the condition where both the arm load is less than the tare and the motor current is less than maximum, the gripper is then opened by moving the gripper motor counterclockwise. If either of the arm load is not less than the tare or the motor current is not less than the maximum, the gripper motor is maintained in an off condition and an alarm sound is sounded.

Figure 12E:
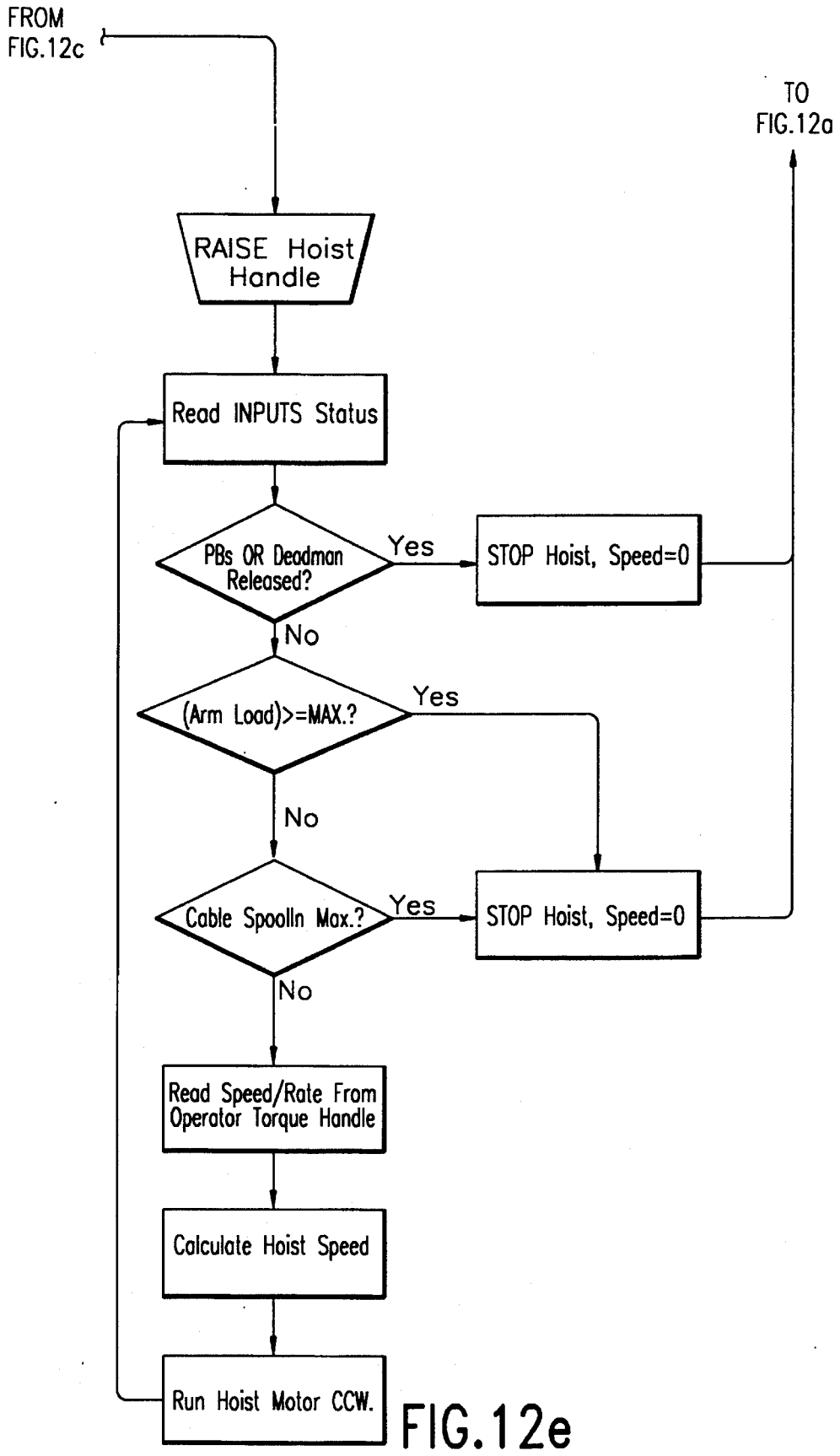
FIG. 12*e* shows the control sequence for raising the hoist.

As shown in FIG. 12*e*, a signal for the raising of the hoist is detected by noting the position of the control handle 47 in an upward position. When the handle is raised, the program determines if the dead man switch is released, and if it is, the hoist is stopped and speed is set to 0. When the dead man switch is not released, the arm load is determined to be greater than or equal to a predetermined maximum. If the arm load is greater, the hoist is stopped and control is returned. If the arm load is not less than the maximum, the program then determines if the spool cable end is at a maximum. If the spool cable is not at a maximum, then the rate input from the torque handle is red. This rate input as noted above is either a lineal function of the angular displacement of the torque handle, or one that is not linear. Next, hoist speed is calculated as a function of the signal from the torque handle, and the hoist motor is operated in a counterclockwise direction.

Figure 12F:
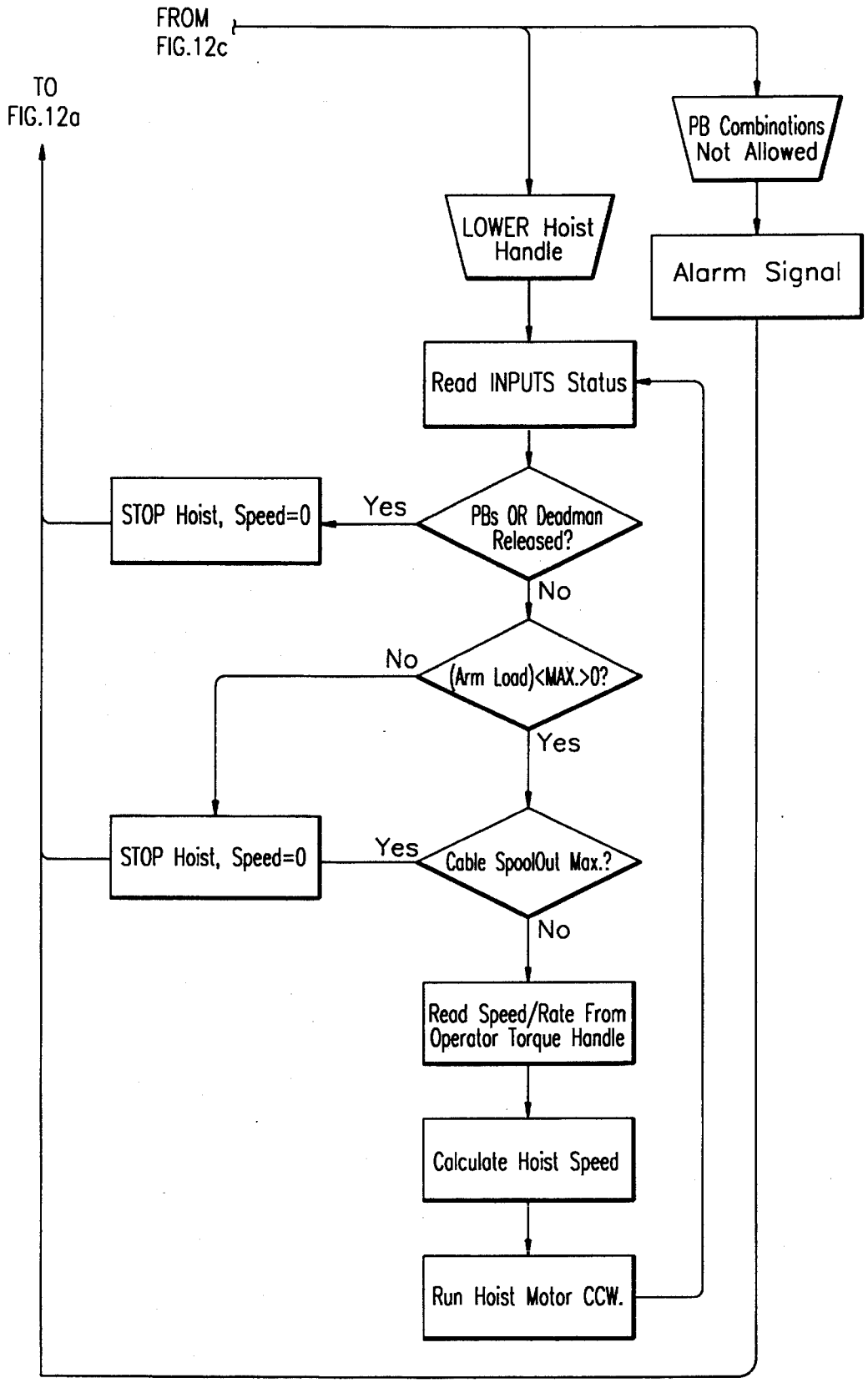
FIG. 12*f* shows the control sequence in response to a lower hoist signal.

As shown in FIG. 12*f*, the computer responds to a lower hoist handle signal by once again considering whether the dead man switch is pressed or released. When the dead man switch is released, the hoist speed is 0 and stopped. When the dead man switch is not released, the program determines if the arm load is less than a predetermined maximum which is greater than 0. If the arm load is not less than the predetermined maximum, the hoist speed is set to 0 and the hoist is stopped. When the arm load is less than the maximum permissible arm load, the computer then checks the cable spool out to determine if it is in maximum condition. If cable spool out is not maximum, the input from the torque is read, the speed is calculated for the hoist, and the hoist motor is run in a counterclockwise direction.

At the far right of FIG. 12*f*, the combinations not accepted provides an alarm signal and an indication to the operator that the combination of handle signals such as raise and lower the handle, a gripper push button, a move push button are improper. An example would be the command to raise the hoist which simultaneously pressing the move button. In this manner, a single function occurs, thereby reducing the risk of injury to a human worker through improper or unintended manipulator command signals.

What is claimed is:

1. An article manipulator comprising in combination:

a scaffold assembly;

an alignment compensating trolley track assembly attached to said scaffold;

a trolley for providing movement along the length of said trolley track;

a first pivot arm;

a second pivot arm;

a hoist mounted on said first arm;

a lift cable connected to said hoist and passing along said first and second arms;

a lift cable guide support means;

a gripper connected to said lift cable for gripping work pieces;

a control system for said manipulator comprising;

an operator control handle; and where in said hoist raises and lowers the lift cable in response to controlling said control handle.

2. The apparatus in accordance with claim 1 wherein the speed of the lift cable is a function of the angular deflection of said operator control handle.

3. The apparatus in accordance with claim 1 wherein said control system includes:

a means for sensing a load on said cable; and means for limiting manipulator operation when the load on the cable exceeds a predetermined maximum.

4. The apparatus in accordance with claim 3 further including means for spooling out cable when said load on the cable is less than or equal to said predetermined maximum load.

5. The apparatus in accordance with claim 4 further comprising an alarm means which is actuated when said cable tension is not less than or equal to a predetermined maximum load.

6. The apparatus in accordance with claim 1 further comprising:

a means for braking said trolley on said track;

a means for braking pivot arm pivot joints, whereby the end of the manipulator is effectively fixed in space when both the means for braking said trolley and the means for braking pivot arm pivot joints axis are applied.

7. The apparatus in accordance with claim 6 further comprising means for locking all of said means for braking when a dead man switch is released.

8. The apparatus in accordance with claim 6 further comprising means for locking all of said brakes and hoist whenever there is a power failure to the manipulator.

9. The apparatus in accordance with claim 1 further comprising an alarm means which is actuated when the load on said cable is not less than or equal to a predetermined maximum load.

10. The apparatus in accordance with claim 1 further comprising an alarm means for signaling when cable spool out is greater than a maximum permissible cable spool out.

11. The apparatus in accordance with claim 1 wherein said operator control system produces an error signal which is used to control a velocity servo connected to said hoist for raising and lowering said lift cable.

12. The apparatus in accordance with claim 11 wherein the error signal used to control the velocity servo is a non-linear function of the control arm position.

13. The apparatus in accordance with claim 11 wherein the error signal is a function of the square of an angle of the control arm.

14. An apparatus for manipulation of a work object comprising in combination:

an alignment compensating scaffold trolley track mounted on said scaffold extending generally parallel to a work area;

a manipulator arm pivotally mounted on a trolley riding on said trolley track, said arm having a plurality of pivot points;

a deadman switch on a control handle;

a manipulator controller, having;

means for unlocking brakes on said arm pivots when said dead man switch is depressed;

means for sensing when a trolley move command is present;

means for sensing when a gripper actuation command is present;

means responsive to said trolley move command when there is no gripper command for locking brakes on each of said manipulator arm pivots, and for unlocking brakes on said trolley; and means for maintaining said trolley brakes unlocked and said pivot arm brakes locked until a further signal is received.

15. The apparatus in accordance with claim 14 further comprising a hoist; and a gripper connected to a free end of said hoist.

16. The apparatus in accordance with claim 14 further comprising a control handle for raising and lowering said hoist.

17. The apparatus in accordance with claim 14 further comprising a gripper control for opening and enclosing said gripper.

18. The apparatus in accordance with claim 14 further comprising a gripper position sensing switch for sensing when said gripper is in an open position; and a means for sensing when the arm load is equal to or less than the empty gripper plus hoist plus cable weight.

19. The apparatus in accordance with claim 14 further comprising means for preventing an operator from unlocking said trolley brakes when there is a load on said arm which exceed the tare weight.

20. The apparatus in accordance with claim 19 wherein said means for preventing trolley moves comprises means for sensing when the arm load is greater than the tare weight and means responsive to said tare weight for releasing said trolley brakes.

21. The apparatus in accordance with claim 14 further comprising a means for opening and closing said gripper which is actuatable only when there is no signal for moving said trolley.

* * * * *